United States Patent [19]

Marchant

[11] 4,251,030

[45] Feb. 17, 1981

[54] RAIL CLIP ASSEMBLIES

[75] Inventor: Ian M. Marchant, Ashtead, England

[73] Assignee: Kins Developments Limited, Epsom, England

[21] Appl. No.: 897,566

[22] Filed: Apr. 18, 1978

[30] Foreign Application Priority Data

Apr. 19, 1977 [GB] United Kingdom ..... 16254/77

[51] Int. Cl.[3] ..... E01B 9/46

[52] U.S. Cl. ..... 238/347; 238/282; 238/362

[58] Field of Search ..... 238/347, 362, 363, 282, 238/310, 331, 333, 338, 343, 344, 345, 346, 361

[56] References Cited

U.S. PATENT DOCUMENTS

| | | | |
|---|---|---|---|
| 828,793 | 8/1906 | Whiteman | 238/347 |
| 1,011,245 | 12/1911 | Rafter | 238/346 |
| 1,439,088 | 12/1922 | Gallagher | 238/282 |
| 3,923,245 | 12/1975 | Marchant | 238/347 |

FOREIGN PATENT DOCUMENTS

| | | | |
|---|---|---|---|
| 503820 | 7/1930 | Fed. Rep. of Germany | 238/347 |
| 634288 | 8/1936 | Fed. Rep. of Germany | 238/338 |
| 662939 | 7/1938 | Fed. Rep. of Germany | 238/347 |

*Primary Examiner*—Robert R. Song
*Assistant Examiner*—Ross Weaver
*Attorney, Agent, or Firm*—Scrivener, Clarke, Scrivener and Johnson

[57] ABSTRACT

A rail clip assembly comprises a body for overlying a portion of a rail and for overlying an adjacent portion of a rail support means, the body having a first surface for abutment with a lateral face of the rail and an aperture for receiving means for securing the body to the rail support means, the aperture being elongate in a direction inclined at an acute angle to the direction of extent of the rail, and securing means including a first securing member for overlying the body and having an aperture therein for alignment with the aperture in the body and for receiving a second securing member which extends therethrough and through the elongate aperture in the body, the first securing member having a surface which in use abuts a second surface of the body in all positions of the body relative to the securing means for transmitting laterally directed forces applied by the rail to the body from the body to the first securing member, the second surface of the body extending in a plane inclined to the rail support means surface and parallel to the direction of elongation of the aperture, the second surface facing away from the first surface.

3 Claims, 9 Drawing Figures

RAIL CLIP ASSEMBLIES

The present invention relates to improvements in rail clip assemblies particularly but not exclusively suitable for securing a rail, such as a crane rail, to a flanged girder.

According to the present invention there is provided a rail clip assembly comprising a body for overlying a portion of a rail and for overlying an adjacent portion of a rail support means, the body having a first surface for abutment with a lateral face of the rail and an aperture for receiving means for securing the body to the rail support means, the aperture being elongate in a direction inclined at an acute angle to the direction of extent of the rail, and securing means including a first securing member for overlying the body and having an aperture therein for alignment with the aperture in the body and for receiving a second securing member which extends therethrough and through the elongate aperture in the body, the first securing member having a surface which in use abuts a second surface of the body in all positions of the body relative to the securing means for transmitting laterally directed forces applied by the rail to the body from the body to the first securing member, the second surface of the body extending in a plane at an angle to the rail support means surface and parallel to the direction of elongation of the aperture, the second surface facing away from the first surface.

Advantageously the body is wedge shaped in the direction of elongation of the aperture and increases in thickness in the direction of approach of the second surface thereof to the rail. Preferably the first securing member is complimentarily wedge shaped, the upper surface of the first securing member being parallel to the lower surface of the body for bearing on the rail support means in all relative positions of the body and the first securing member.

The present invention will be more fully understood from the following description of embodiments thereof, given by way of example only, with reference to the accompanying drawings in which.

Figure 1:
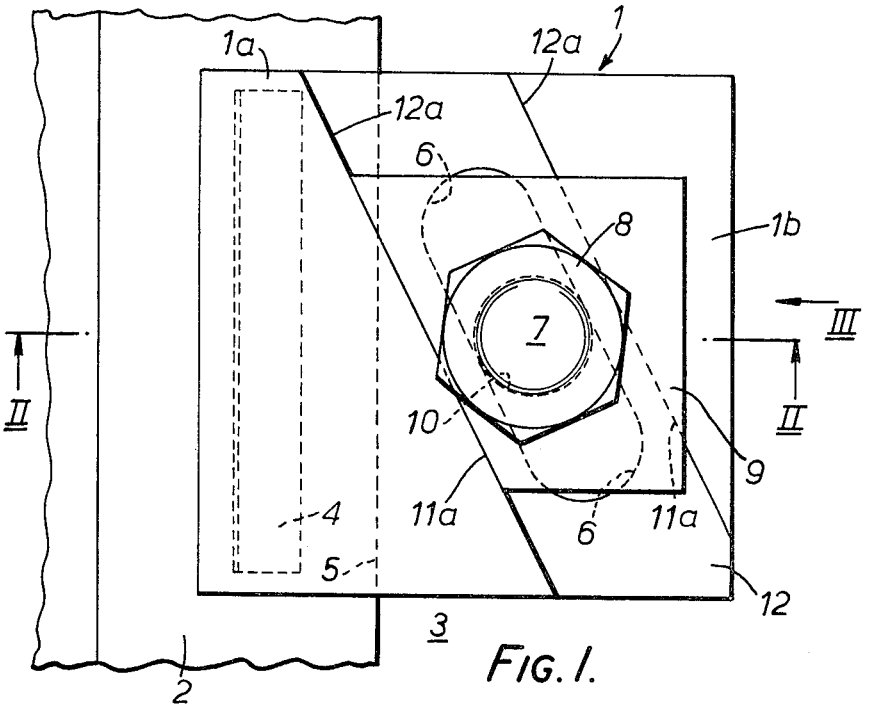
FIG. 1 is a plan view of an embodiment of a rail clip assembly according to the present invention when in use.
Figure 2:
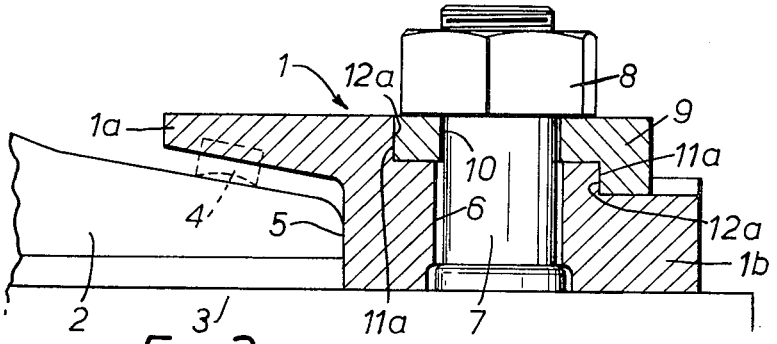
FIG. 2 is a section on the line II—II of FIG. 1.
Figure 3:
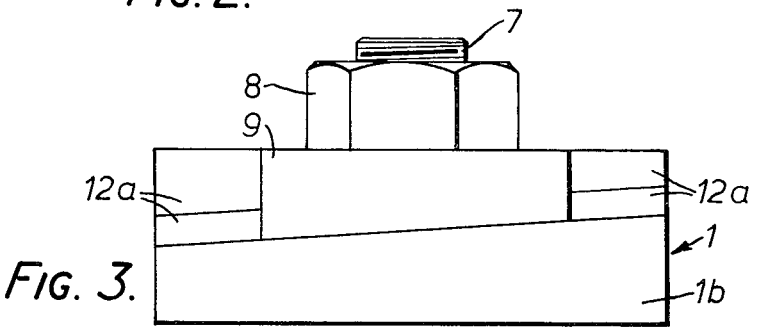
FIG. 3 is an elevation in the direction of the arrow III in FIG. 1.

The assembly shown in FIGS. 1 to 3 comprises a body 1 having a first portion 1*a* for overlying a lateral flange 2 of a rail, and a second portion 1*b* for overlying the rail support means 3, e.g. a flanged girder. The first portion 1*a* may be intended simply to provide an upper limit on upward movement of the rail flange and be normally spaced from the upper surface of the flange. Alternatively the portion 1*a* may bear on the flange through a resiliently compressible pad 4 (shown in broken lines) which is located in a recess in the surface of portion 1*a* facing the flange 2. The pad 4 is made of an elastomeric material, e.g. natural or synthetic rubber, and may be provided with a planar or recessed bearing surface.

The second portion 1*b* of body 1 has a surface 5 which is intended to abut the lateral face of flange 2 to limit lateral movement of the rail, and an aperture 6 for receiving means for securing the body relative to the rail support 3. The securing means includes a bolt or, as shown, a stud 7 with a nut 8, which stud 7 projects from and is secured to the rail support 3, and a member 9, to be more fully described hereafter, which lies between the nut 8 or the head of the bolt and the upper surface 12 of the body 1.

To accommodate the variations in the positioning of the stud 7 (or bolt) relative to the rail and to facilitate re-positioning of the rail relative to the stud, the aperture 6 in the body 1 is made elongate in a direction inclined to the direction of extent of surface 5. Thus the body 1 can be moved relative to the stud 7, within the limits of aperture 6, to abut surface 5 with the lateral face of the rail flange 2.

To prevent laterally directed forces applied by the rail to the body 1 being transmitted directly to the stud 7 (or bolt), the member 9 is provided which interacts with the body 1. Member 9 has an aperture 10 dimensioned to receive the stud 7 (or bolt) and is provided with a lateral surface 11*a* which abuts a surface 12*a* on the body 1. The surface 12*a* extends substantially perpendicularly to the plane of the rail support surface and in the direction of elongation of the aperture 6, and faces in a direction opposite to that of surface 5. Surface 11*a* on the member is correspondingly positioned so that surfaces 11*a*, 12*a* are in abutment in all relative positions of the body 1 and the stud 7. In use, a force applied laterally by the rail to surface 5 is transmitted via surfaces 11*a*, 12*a* to the member 9 and will result, if friction between the abutting surfaces of the member 9 and body 1, and between the body 1 and the rail support surface, is overcome, in movement of the body 1 relative to the member 9 in the direction of extent of the surface 12*a*.

As shown, the upper surface 12 of the body 1 is stepped to provide two surfaces 12*a*, both of which are directed away from the rail and extend parallel to the direction of elongation of the aperture 6. The member 9 is provided with a pair of corresponding surfaces 11*a*.

In use, the body 1 and member 9 are loosely assembled on the stud 7 and the body 1 is moved relative to the stud and member 9 until the surface 5 abuts the rail flange 2. The nut 8 is then threaded onto the stud and is tightened to fix the body 1 relative to the member 9 and the rail relative to the rail support. Should the rail require repositioning, it is merely a matter of loosening the nut 8, repositioning the body so that surface 5 agains abuts the rail flange 2, and retightening the nut.

The body 1, and preferably also, as shown, the member 9 are advantageously complimentarily wedge shaped, the body increasing in thickness in the direction of extent of the aperture 6 and towards the rail. With such shaping of the body, if the rail tends to move laterally towards the body 1, the body 1 will tend to move in the direction of extent of surface 12*a* and so as to increase the thickness of the body 1 in the region of the stud 7. This has the effect of increasing the tension in the stud 7 and therefore increasing the frictional forces between the body 1, rail support 3 and member 9 to resist further lateral movement of the rail.

Figure 4:
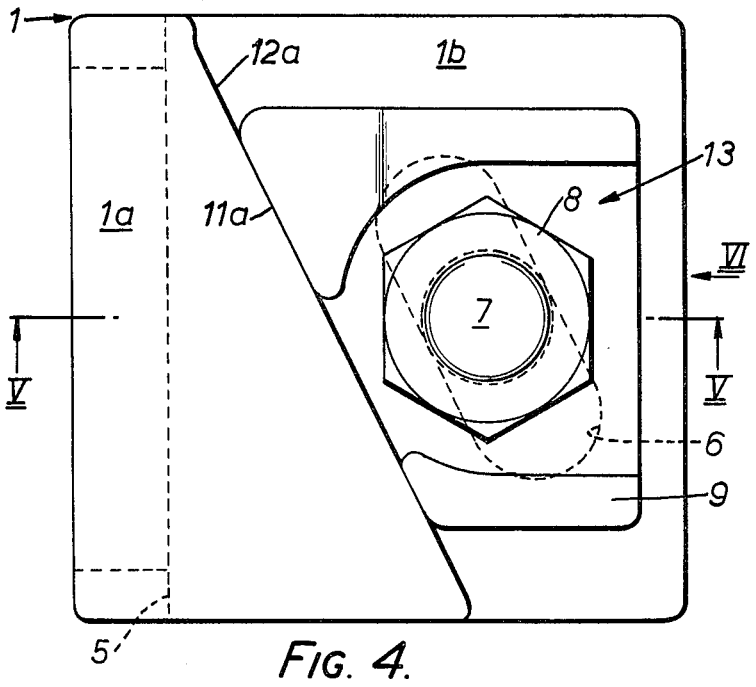
FIG. 4 is a plan view of another embodiment of a rail clip assembly when in use.
Figure 5:
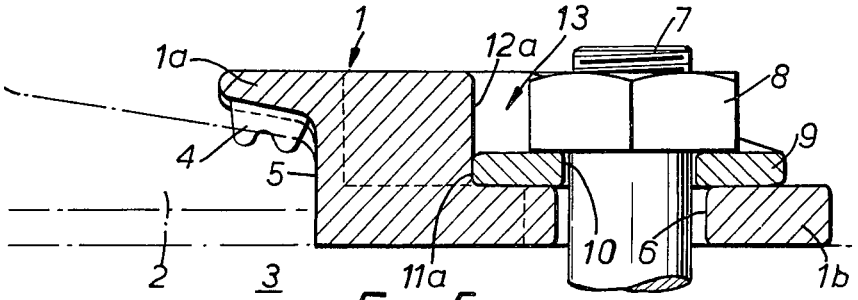
FIG. 5 is a section on the Line V—V of FIG. 4.
Figure 6:
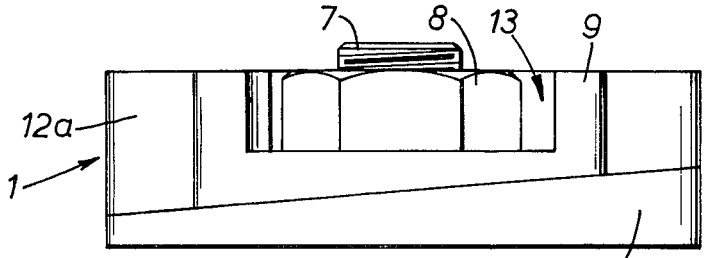
FIG. 6 is an elevation in the direction of the arrow VI in FIG. 4.

The assembly shown in FIGS. 4 to 6 is similar in construction and operation to that of FIGS. 1 to 3 and corresponding parts have been given the same reference numerals.

In this embodiment the upper surface 12 of the body 1 has a single step providing a single surface 12*a* and the member 9 is shaped to provide a single surface 11*a* for abutment with surface 12*a*. The member 9 is dimensioned relative to the body 1 so that the upper surface of the nut 8 (or head of the bolt) is substantially flush with the upper surface of the body 1. To this end, the member 9 is formed with a recess 13 to accommodate the nut 8 together with a nut tightening tool. As in the preceding embodiment, the body 1 and preferably also the member 9 are complimentary wedge shaped.

In the foregoing embodiments the surfaces 11*a*, 12*a* are substantially perpendicular to the rail support surface and the lower surface of portion 1*b*. It will be appreciated that these surfaces may be inclined at an acute angle to the rail support surface.

Figure 7:
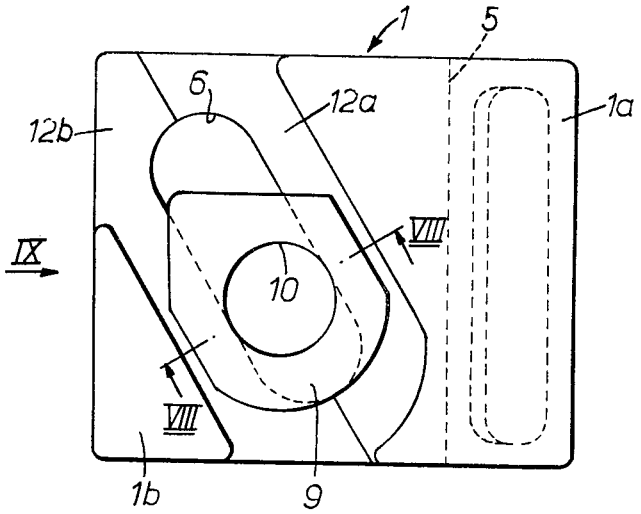
FIG. 7 is a plan view of another embodiment of a rail clip assembly.
Figure 8:
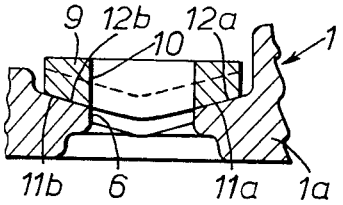
FIG. 8 is a section on the line VIII—VIII of FIG. 7.
Figure 9:
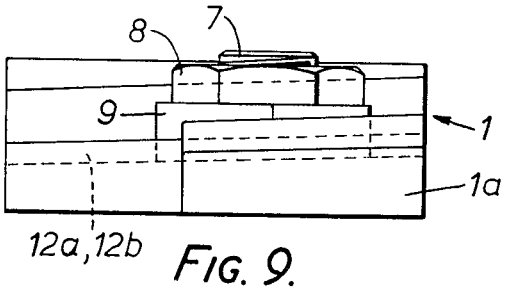
FIG. 9 is an elevation in the direction of the arrow IX in FIG. 7.

The assembly shown in FIGS. 7 to 9 is similar in construction and operation to that of FIGS. 3 and 4 and again corresponding parts have been given the same reference numerals. In FIGS. 7 and 8, the stud and nut (or bolt) have been omitted for ease of understanding.

In this embodiment, the abutting surfaces 12*a*, 11*a* of the body 1 and member 9 are inclined at an acute angle to the plane of the rail support surface, rather than, as in the preceding embodiments, being substantially perpendicular to the plane of the rail support surface. The surfaces 12*a*, 11*a* are matched by corresponding oppositely inclined surface 12*b*, 11*b*, surfaces 12*a*, 12*b* being symmetrical about the axis of elongation of the aperture 6 and surfaces 11*a*, 11*b* being symmetrical about an axis intersecting the axis of aperture 10 so that, in assembling the member 9 with the body 1, the member 9 automatically centres itself relative to the aperture 6. This feature has the advantage that bolts or studs of different diameters can be used with appropriate members 9 having appropriately dimensioned apertures 10 but the same body 1, the transverse dimension of the aperture 6 in the body 1 corresponding to the maximum diameter of a stud or bolt to be used to secure the assembly to the rail support.

The body 1 and member 9 of the above described embodiments may be made of cast steel, malleable cast iron or other similar material. The slot may for example extend at an angle of 30° to the surface 5 and the upper surface 12 of the body 1 may have an inclination, relative to its lower surface, of 8%, the lower surface of member 9 having a corresponding inclination relative to its upper surface so that the upper surface of member 9 and lower surface of body 1 remain parallel in all relative positions thereof.

What is claimed is:

1. A rail clip assembly comprising:

a body for overlying a portion of a rail and for overlying an adjacent portion of a rail support means, said body defining a first surface for abutment with a lateral face of the rail, a second surface facing away from said first surface and an aperture for receiving means for securing said body to the rail support means, said aperture being elongate in a direction inclined at an acute angle to the direction of extent of the rail; said means for securing said body to the rail support means including a first securing member for overlying said body and having an aperture therein for alignment with said aperture in said body and for receiving a second securing member which extends therethrough and through said elongate aperture in said body, said second securing member in its position of use being fixed to said support means against movement relative thereto, said first securing member defining a surface which in use abuts said second surface of said body in all positions of said body relative to said securing means for transmitting laterally directed forces applied by the rail to said body from said body to said first securing member, and from the latter to said second securing member and to said rail support means, said surface of said first securing member and said second surface of said body extending in a plane inclined to the direction of extent of the rail and parallel to the direction of elongation of said elongate aperture, the upper surfaces of said first securing member being parallel with the part of the lower surface of said body bearing on the rail support surface for all relative positions of said body and said first securing member, said second surface of said body extending at an acute angle to a vertical plane through the axis of elongation of said aperture and a third surface on said body extending in a plane parallel to the axis of elongation of said aperture therein, said second and third surfaces being symmetrical about the axis of elongation of said aperture, said first securing member having a surface corresponding to said third surface of the body and for abutment therewith.

2. An assembly as claimed in claim 1 wherein said body and said first securing member are complementarily wedge shaped in the direction of elongation of the aperture in said body.

3. An assembly as claimed in claim 1, wherein said second and third surfaces of said body form a V-shaped channel, said elongate aperture being positioned along the apex of said V.

* * * * *